United States Patent [19]

Foote

[11] Patent Number: 4,812,383

[45] Date of Patent: Mar. 14, 1989

[54] PROCESS FOR FORMING ELECTROPHOTOGRAPHIC IMAGES ON A SELF-FUSING SUBSTRATE

[75] Inventor: D. Paul Foote, Sierra Madre, Calif.

[73] Assignee: Xerox Corporation, Stamford, Conn.

[21] Appl. No.: 115,010

[22] Filed: Oct. 29, 1987

[51] Int. Cl.[4] ..... G03G 13/16; G03G 13/22

[52] U.S. Cl. ..... 430/126; 430/47

[58] Field of Search ..... 430/47, 126

[56] References Cited

U.S. PATENT DOCUMENTS

| | | | |
|---|---|---|---|
| 3,419,411 | 12/1968 | Wright | 430/126 X |
| 3,758,327 | 9/1973 | York | 430/126 X |
| 3,839,032 | 10/1974 | Smith et al. | 430/126 X |
| 3,928,656 | 12/1975 | Stella et al. | 430/98 |
| 4,259,425 | 3/1981 | Serlin | 430/56 |
| 4,332,851 | 6/1982 | Hosomura et al. | 428/325 |
| 4,461,823 | 7/1984 | Held | 430/126 X |
| 4,624,544 | 11/1986 | Jeromin | 355/3 R |
| 4,661,431 | 4/1987 | Bujese et al. | 430/126 |

*Primary Examiner*—Roland E. Martin

*Attorney, Agent, or Firm*—Judith L. Byorick

[57] ABSTRACT

Disclosed is a process for forming permanent electrophotographic images comprising: (a) generating, in an electrophotographic imaging apparatus, an electrostatic latent image; (b) developing said image with a liquid developer composition which comprises a colorant, a solvent, and a first polymeric material having adhesive properties when wetted with said solvent; (c) transferring said image to a substrate while said image is wet, said substrate having a coating comprising a second polymeric material having adhesive properties when wetted with said solvent; and (d) permitting said image to dry on said substrate.

28 Claims, No Drawings

PROCESS FOR FORMING ELECTROPHOTOGRAPHIC IMAGES ON A SELF-FUSING SUBSTRATE

BACKGROUND OF THE INVENTION

The present invention is directed to a process for forming electrophotographic images. More specifically, the present invention is directed to a process for forming electrophotographic images wherein the developed transferred image becomes permanently affixed to a substrate in the absence of the fusing or fixing thereof. One embodiment of the invention is directed to a process for forming permanent electrophotographic images that comprises generating, in an electrophotographic imaging apparatus, an electrostatic latent image; developing the image with a liquid developer comprising a colorant, a solvent, and a polymeric material having adhesive properties when wetted with the solvent; transferring the image to a substrate having a coating comprising a polymeric material having adhesive properties when wetted with the liquid developer solvent; and permitting the image to dry on the substrate.

The formation and development of images on the surface of photoconductive material by electrostatic means is well known. For example, U.S. Pat. No. 2,297,691 discloses an electrophotographic imaging process that entails placing a uniform electrostatic charge on a photoconductive insulting layer such as a photoconductor or photoreceptor, exposing the photoreceptor to a light and shadow image to dissipate the charge on the areas of the photoreceptor exposed to the light, and developing the resulting electrostatic latent image by depositing on the image a finely divided electroscopic material known as toner. The toner will normally be attracted to those areas of the photoreceptor which retain a charge thereby forming a toner image corresponding to the electrostatic latent image. This developed image may then be transferred to a substrate such as paper, and subsequently be permanently affixed to the substrate. Typical methods of fixing or fusing the developed image include employment of means such as heat, pressure, a combination of heat and pressure, or other suitable fixing means such as an overcoating or solvent treatment. The present invention, however, provides a process for affixing an electrophotographic image to a substrate with no necessity for a fusing step. Rather, upon transfer of the developed image to the substrate and drying of the developer composition, the image is permanently affixed to the substrate.

Reported methods of affixing developed electrophotographic images to a substrate include the application of heat or pressure to the transferred image. For example, U.S. Pat. No. 3,928,656 discloses a pressure fixable toner in which the resinous material is a weakly crosslinked amorphous polymer. The crosslinks in the polymer can be disrupted or broken by the application of pressure after which the polymer becomes sufficiently soft to be fixed to the substrate by pressure.

Coated electrophotographic substrates are also known. For example, U.S. Pat. No. 4,332,851, discloses a coated paper suitable for use in an electrophotographic process for receiving an image formed by a magnetic brush apparatus with a single component developer. The coating composition comprises a crosslinking agent and a styrene/butadiene latex as well as any desired pigment composition and nonionic emulsifier. According to the patent, paper coated with this composition in amounts of 1 to 5 grams per square meter exhibits superior transferrability and pressure fixability.

Another patent, U.S. Pat. No. 4,259,425, discloses an electrographic recording sheet coated with a polymeric binder to improve toner adhesion. The electrically insulating coating comprises a polymeric binder of a polyvinyl acetal present in an amount of from 40 to 90 parts by weight and a polystyrene or a poly ($\alpha$-methylstyrene) present in an amount of from 10 to 60 parts by weight as well as an inert, finely divided pigment present in an amount of up to 500 parts by weight per 100 parts by weight of the polymeric binder. A conductive sheet support coated with this composition exhibits improved toner retention when the developed recording material, which has been fixed by the application of heat or pressure, is subjected to an adhesion test.

Although the known materials and methods for permanently affixing electrophotographic images to substrates are suitable for their intended purposes, a need exists for a process for forming permanent electrophotographic images with no fixing or fusing step. Such a process possesses many advantages, including the enablement of inexpensive electrophotographic imaging systems containing no large, costly fusing devices. In addition, images produced according to the process of the present invention possess and retain a high degree of contrast and resolution; the process is thus suitable for applications such as xeroradiographic medical imaging, which requires high contrast and high resolution images.

SUMMARY OF THE INVENTION

It is an object of the present invention to provide a process for forming permanent electrophotographic images with the above advantages and with no fixing or fusing step.

It is another object of the present invention to provide a process for forming permanent electrophotographic images on a self-fusing substrate that enables inexpensive electrophotographic imaging systems containing no large, costly fusing devices.

It is yet another object of the present ivnention to provide a process for forming permanent electrophotographic images wherein the images possess and retain a high degree of contrast and resolution.

Another object of the present invention resides in the provision of a process for forming permanent electrophotographic images that is suitable for use in a xeroradiographic medical imaging apparatus.

These and other objects of the present invention are achieved by providing a process for forming permanent electrophotographic images comprising: (a) generating, in an electrophotographic imaging apparatus, an electrostatic latent image; (b) developing said image with a liquid developer composition which comprises a colorant, a solvent, and a first polymeric material having adhesive properties when wetted with said solvent; (c) transferring said image to a substrate while said image is wet, said substrate having a coating comprising a second polymeric material having adhesive properties when wetted with said solvent, and (d) permitting said image to dry on said substrate.

It is believed that the process of the present invention results in permanent images with no need for a thermal, pressure, or other fusing step because of the interaction between the polymeric material in the liquid developer and the polymeric material in the coating on the substrate. Transfer of the developed image occurs while the image is wet with the solvent or dispersant of the liquid developer. The liquid developer contains at least one polymeric material dissolved in the solvent, which polymeric material exhibits adhesive properties when wet. Also contained in the liquid developer is a colorant, which is believed to be adsorbed onto the polymeric material. During the wet electrostatic transfer step, the solvent or dispersant of the liquid developer wets the coating on the substrate, which coating also contains polymeric material that exhibits adhesive properties when wet. The solvent or dispersant softens the polymeric material in the coating, activating its adhesive properties. At this time, the polymeric material in the developer, upon which is adsorbed the colorant material, and the polymeric material in the coating interact and adhere becoming physically attached to each other. The developed and transferred image thus essentially becomes "glued" to the substrate, and after the image has dried, it is relatively permanent. Accordingly, no need exists for further fixing or fusing.

For the purposes of the present invention, substantially any electrophotographic imaging apparatus suitable for use in conjunction with a liquid developer of the type described herein may be used. Provided that the apparatus is compatible with liquid development, any optical or electronic copier, printer, duplicator, or other electrophotographic system may be selected. In addition, the present invention is suitable for use in a xeroradiographic medical imaging system, such as the Xerox® 175 system, commercially available from Xerox Medical Systems, Pasadena, CA. The Xerox® 175 is described in U.S. Pat. No. 4,624,544, the disclosure of which is totally incorporated herein by reference, and is an automatic system for developing an image from a xerographic plate, which during exposure to x-rays and ambient light is enclosed in a cassette comprising a development station, an image transfer station, a cleaning station, a changing station, input-output means, and an elevator having, from bottom to top, a stack of stored plates, a first, second, third and fourth level, the fourth level having a means for heating said plate to remove residual images, wherein the above mentioned components are situated within the system in the order stated from one end of the system to the other, said input-output means further comprising, from top to bottom, an input station into which the cassette containing an exposed plate is inserted, an output station from which is discharged a charged plate enclosed within a cassette, and an image output station where the finished image, on paper, is delivered to the operator; and further comprising means for transporting said plate through the system, which also has levels corresponding to those of the elevator, to the various stations in the following order; from the input station to the first level of the elevator, to the third level, to the other end of the system, to the second level, to the development station, to the transfer station, to the cleaning station, to the elevator, to the fourth level, and then onto the top of the stored stack of plates. This system, as stated at column 2, line 66, to column 3, line 2 of the patent, employs a fusing process which entails self-fusing where the paper has a surface coating which reacts with the solvent in the toner to trap the toner particles, and where the paper needs only to be dried to complete the image making process.

The liquid developer employed in the process of the present invention comprises a colorant, a solvent, and a polymeric material having adhesive properties when wetted with the solvent. Colorants chosen may be of any type suitable for use in a liquid developer, such as a pigment or a dye. Typical colorants include carbon black, nigrosine dye, aniline blue, and mixtures thereof, with carbon black being the preferred colorant. Colorants having a color other than black are also suitable for use with the present invention, including red, green, blue, brown, magenta, cyan, and yellow colorants, as well as mixtures thereof. Illustrative examples of magenta colorants include 2,9-dimethyl-substituted quinacridone and anthraquinone dye, identified in the Color Index as Cl 60710, Cl Dispersed Red 15, a diazo dye identified in the Color Index as Cl 26050, Cl Solvent Red 19, and the like. Illustrative examples of suitable cyan colorants include copper tetra-4-(octadecyl sulfonamido) phthalocyanine, X-copper phthalocyanine pigment, listed in the Color Index as Cl 74160, Cl Pigment Blue, Anthradanthrene Blue, identified in the Color Index as Cl 69810, Special Blue X-2137, and the like. Illustrative examples of yellow colorants include diarylide yellow 3,3-dichlorobenzidene acetoacetanilides, a monoazo pigment identified in the Color Index as Cl 12700, Cl Solvent Yellow 16, a nitrophenyl amine sulfonamide identified in the Color Index as Foron Yellow SE/GLN, Cl Dispersed Yellow 33, 2,5-dimenthoxy-4-sulfonanilide phenylazo-4'-chloro-2,5-dimenthoxy aceto-acetanilide, Permanent Yellow FGL, and the like. When mixtures of colorants are chosen, the colorants are present in a ratio that renders a developer with the desired color. The colorant should be present in an amount sufficient to render the developer high colored to permit the formation of a clearly visible image on a recording member. Generally, the colorant is present in an amount of from about 1 percent to about 25 percent by weight of the developer, and preferably from 10 to 18 percent; however, lesser or greater amounts of the colorant may be present provided that the objectives of the present invention are achieved.

Also included in the liquid developer is a solvent or dispersing agent. The solvent or dispersing agent may be of any type suitable for use in liquid developers provided that the polymeric material upon which the colorant is adsorbed in soluble therein, and that it will soften the polymeric material present in the substrate coating. Preferred solvents include the family of isoparaffinic hydrocarbon solvents, such as those commercially available as Isopar® from Exxon Chemical Co., or Shell Sol® from Shell Oil Company. In particular, Isopar® G, which has a flash point of about 105° F. and a specific gravity of from about 0.74 to about 0.76 at about 15.6° C., is preferred for the process of the present invention. The solvent is present in the developer in an amount of from about 50 to about 98 percent by weight, and preferably from about 80 to about 90 percent by weight.

Polymeric materials suitable for the developer have the characteristics of being soluble in the solvent of the liquid developer and of having adhesive properties during the period when the solvent is being driven off or evaporated from a solution of the solvent and the polymeric material. Perferably, the polymeric material is of the same composition as the polymeric material included in the substrate coating; these two polymeric materials, however, may be of different compositions provided that they are compatible for the purpose of adhering to each other during the period when the developer solvent is evaporating, such that the objectives of the present invention are achieved. An example of a polymeric material having the requisite characteristics is a vinyl toluene acrylic terpolymer resin, such as Pliolite® OMS, manufacturer by Goodyear Co. and commerically available from E. T. Horn Co., Le Mirada, CA. The polymeric material is present in the liquid developer in an amount of from about 1 to about 20 percent by weight, and preferably from about 5 to about 10 percent by weight. One suitable liquid developer is disclosed in copending application U.S. Ser. No. 07115,009, the disclosure of which is totally incorporated herein by reference.

Transfer of the developed image from the photoconductor to the substrate occurs while the image is wet. The transferring step may be performed by any suitable method, such as by pressing the substrate into contact with the photoreceptor with a blade to assure firm contact of the paper to the image, activating a transfer corotron and depositing a charge on the back of the substrate to attract the image to the substrate, and removing the substrate from the photoreceptor, as disclosed in U.S. Pat. No. 4,624,544, the disclosure of which is totally incorporated herein by reference.

The substrate employed for the process of the present invention may be of any type suitable for receiving electrophotographic images, including paper, such as Xerox®- 4024 paper or transparency material, such as that formulated from Mylar®, acetate, or polyester films. Substrates chosen may possess an optional clay coating to seal the substrate rendering it less absorbent so that the coating material does not soak into the substrate during the coating process. If employed, the optional clay coating enables a thinner coating of the polymeric material since the polymeric material remains on the surface of the clay coating substrate instead of becoming absorbed into the fibers. In addition, a clay coating performs functions such as covering dirt in the base substrate, providing opacity, and improving brightness. An example of a suitable substrate is a paper having a basis weight of from about 201 to about 223 grams per square meter and a caliper of from about 8 to about 9 mils, such as is commercially available from Union Camp Corp., Wayne, NJ. This paper possesses a clay coating on the back (non-imaging) side and a subcoat comprising a clay material in a latex binder on the imaging side of the paper, which subcoat may be applied from an aqueous dispersion of the clay in the binder to provide a clay subcoating thickness of about 0.0005 inch. Subsequent to application of the clay subcoat, the paper web may be run through a supercolander machine to give the paper a smooth, level surface.

A coating comprising a polymeric material is present on the surface of the substrate employed for the process of the present invention. This polymeric material should be at least partially soluble in the solvent of the liquid developer, such that it will possess adhesive properties when wetted with the liquid developer solvent. The polymeric material in the coating should also be compatible with the polymeric material contained in the liquid developer in that particles of the polymeric material in the liquid developer, and particles of the polymeric material in the coating will interact and adhere to each other when the wet developed image contacts the coated substrate. Since the polymeric material particles in the liquid developer contain, adsorbed upon their surfaces, the colorant material of the developer, the colorant also adheres to the polymeric material in the coating when the developer material and the coating material interact. Upon drying of the image, the colorant particles thus become physically attached to the substrate. An example of a polymeric material suitable for the coating is a vinyl toluene acrylic terpolymer, such as Pliolite® OMS, manufactured by Goodyear Co. and available from E. T. Horn Co., La Mirada, CA. Preferably, the polymeric material selected for the coating is of the same composition as that selected for the liquid developer, although they may be different, provided that the objectives of the present invention are achieved.

Although the coating on the substrate may consist solely of the polymeric material, other components may also be added to the coating composition to enhance aspects of the imaging process other than fixing or fusing of the image to the substrate. The polymeric material is present in the coating material in an amount of from about 30 to 100 percent by weight, and preferably in an amount of from aobut 80 to about 95 percent by weight. Other components may be resins, including vinyl resins such as a vinyl chloride/vinyl acetate/-maleic acid terpolymer, commercially available as VMCH resin from Union Carbide Co., which materials may be added to the coating composition for purposes such as preventing "blocking", or sticking together of the substrate sheets when stored above temperatures of about 120° to 130° F., or for improving substrate feeding in the electrophotogtraphic imaging apparatus. Added components such as a vinyl resin may also be helpful for improving adhesion between the coating composition and the substrate. A vinyl resin component may be present in an amount of from about 1 to about 70 percent by weight. Another potential optional additive is a pigment added for purposes such as improving image contrast by altering the color of a paper substrate, improving the abrasion resistance of the images, controlling the amount of gloss in the substrate, or improving paper feeding. Suitable pigments include silica pigments, such as Ansilex® pigment, available from Engelhardt Industries. A pigment additive may be present in amounts of from about 1 to about 50 percent by weight of the coating composition, and the total amount of all additives present may be up to about 70 percent by weight of the coating composition.

The coating composition may be prepared by first preparing a solvent, such as a mixture of ethyl acetate and acetone, adding to the solvent the polymeric material, such as Pliolite® OMS, and stirring the solution at low speed until the polymeric material is dissolved in the solvent. If a vinyl resin is to be present in the coating composition, it is next added to the solution and the solution is stirred at medium speed until a smooth paste is obtained. When a pigment is to be present in the coating composition, it is added subsequent to the addition of the vinyl resin by adding it to the solution and stirring at low speed until a smooth paste is obtained. An additional amount of the solvent is then added as the solution is stirred at low speed until a homogeneous mixture is achieved. The mixture is filtered to remove undissolved solids, and is then ready for application to a substrate.

For applying the coating composition to the substrate, any suitable method may be employed. For example, the coating composition may be dissolved in one or more solvents, such as a mixture of about 50 percent acetone and about 50 percent ethyl acetate; in an acetone/ethyl acetate solvent system, a level of about 20 percent by weight of the solid components of the coating composition in the solution has been observed to work well. A mist of the solvent - coating composition mixture may be sprayed onto the substrate surface, after which the solvent is permitted to evaporate. Another suitable method is application of the coating solution by means of a doctor blade, wherein the solution is poured onto a flexible blade, and a uniform layer of the coating solution is applied to a passing substrate, after which the solvent is permitted to evaporate. A third suitable method is application of the coating by means of a Meyer rod, wherein a solution of the coating composition is poured onto a rod having wire wrapped tightly around it in a spiral configuration, such that the wire contacts the substrate at uniform intervals, and the coating solution is metered onto the substrate in the areas where the wire does not contact the substrate. The coating composition may be applied to the substrate in the thickness desired to achieve the objects of the present invention. For example, the coating may be present on the substrate in amounts of from about 1 to about 100 grams per square meter. For conventional copying applications, heavier coating weights may be desired of from about 10 to about 100 grams per square meter. For specialized applications, such as the formation of xeroradiographic diagnostic medical images, thinner coating weights of from about 1 to about 12 grams per square meter, and preferably from about 6 to about 8 grams per square meter, or about 0.00002 inch are preferred. Coating weights of from about 6 to about 8 grams per meter may be obtained by applying the coating composition to the substrate with a No. 16 Meyer rod, and subsequently passing the substrate through forced air drying ovens at temperatures of, for example, from 120° to 160° F., and adjusted to result in a final paper moisture content of from about 3 to about 5 percent as measured with a Moistrex® Meter.

During the transfer step of the imaging process, the coated substrate receives the developed image. After transfer of the developed image to the coating substrate, the solvent in the liquid developer is permitted to evaporate, leaving the dried image permanently affixed to the substrate. The solvent may be evaporated by any suitable method. For example, if only one developed image is formed at a given time, the image may simply be permitted to dry by exposure to the air at room temperature. When other images are being formed immediately afterwards, such that stacking of the imaged substrates is desired, the images should be dried before coming into contact with other materials to prevent sticking or smearing. In this instance, the images may be dried by the application of forced air by means of a blower or other suitable device, at either ambient temperature or elevated temperatures.

Specific embodiments of the invention will now be described in detail. These example are intended to be illustrative, and the invention is not limited to the material, conditions, or process parameters set forth in these embodiments. All parts and percentages are by weight unless otherwise indicated.

EXAMPLE I

A coating composition is prepared by combining 150 grams of ethyl acetate and 105 grams of acetone to form a solvent mixture. One half of the resulting solvent mixture is then added to a one quart container of a Waring® Blender. To this solvent mixture is added 34.5 grams of Pliolite® OMS, a vinyl toluene acrylic terpolymer commercially available from Goodyear Corp., and the mixture is stirred on the blender at low speed for about 2 minutes until the Pliolite® dissolves. To this solution is then added 6.1 grams of VMCH vinyl resin, a vinyl chloride/vinyl acetate/maleic acid terpolymer resin commercially available from Union Carbide, and the solution is stirred for about 1 minute at medium speed until a smooth paste is obtained. Ansilex® pigment, a silica pigment commercially available from Engelhardt Industries, is then introduced into the solution in an amount of 4 grams, and the mixture is stirred at low speed for about 5 minutes, and then at high speed for about 25 minutes until a smooth white paste is obtained. The remaining half of the solvent mixture is then introduced into the solution, and the solution is stirred in the blender at low speed until a homogeneous mixture is achieved. The resulting mixture is subsequently filtered through 300 mesh polyester fiber.

EXAMPLE II

To a base paper having a basis weight of from about 201 to about 223 grams per square meter and a caliper of from aobut 8 to about 9 mils, commercially available from Union Camp Corp., Wayne, NJ, and having a clay coating on the back (non-imaging) side, is applied a subcoat on the imaging side of the paper, said subcoat comprising an aqueous dispersion of a clay material in a latex binder to provide a clay subcoating in a thickness of about 0.0005 inch. Subsequent to the application of the clay subcoat, the paper web is run through a supercolander machine to give the paper a smooth, level surface.

A coating composition wherein the solid component comprises about 75 percent by weight of a vinyl toluene acrylic terpolymer commercially available from Goodyear Corp. as Pliolite® OMS, about 15 percent by weight of a vinyl chloride/vinyl acetate/maleic acid terpolymer resin commercially available from Union Carbide as VMCH vinyl resin, and about 10 percent by weight of a silica pigment commercially available from Engelhardt Industries as Ansilex® pigment is then prepared by the method of Example I. The coating composition in the ethyl acetate/acetone solvent system is applied to the paper with a No. 16 Meyer rod to give a solids coat weight of 7 ± 1 grams per square meter. Subsequent to the application of the coating composition, the paper web is passed through three forced air drying ovens with temperatures set in the range of 120° to 160° F. and adjusted to give a final paper moisture content of 4 ± 1 percent as measured with a Moistrex® Meter. Samples of the paper are then cut into 4 inch by 4 inch squares, and several of the squares are placed together in a stack. To this stack is applied a pressure of 0.5 pounds per square inch, and the stack is placed in a 120° F. oven for 24 hours. After this time, no "blocking" or adhesion between the paper sheets, was observed.

EXAMPLE III

An electrostatic latent image is formed in a Xerox® 175 Medical Imaging System. A liquid developer composition comprising an isoparaffinic hydrocarbon dispersing agent commercially available as Isopar® G from Exxon Chemical Co., present in an amount of about 90 percent by weight, a carbon black colorant, present in an amount of about 5 percent by weight, a vinyl toluene acrylic terpolymer commercially available from Goodyear Corp. as Pliolite® OMS, present in an amount of about 2 percent by weight, and a butylated hydroxy toluene preservative, present in an amount of about 1 percent by weight, is present in the development housing of the imaging apparatus. The image is developed with the liquid developer and transferred to the coated paper substrate of Example II by pressing the substrate into contact with the photoreceptor with a blade to assure firm contact of the paper to the image, activating a transfer corotron and depositing a charge on the back of the substrate to attract the image to the substrate, and removing the substrate from the photoreceptor. The transferred image on the substrate is then removed from the imaging system and permitted to dry at room temperature until completely dry. Upon drying of the substrate, the image exhibits a substantially permanent quality and no smearing of the image is observed when the image is rubbed with human fingers or with a tissue.

EXAMPLE IV

An electrostatic latent image is formed in a Xerox® 175 Medical Imaging System. A liquid developer composition comprising an isoparaffinic hydrocarbon dispersing agent commercially available as Isopar® G from Exxon Chemical Co., present in an amount of about 90 percent by weight, a carbon black colorant, present in an amount of about 5 percent by weight, a vinyl toluene crylicl terpolymer commercially available from Goodyear Corp. as Pliolite® OMS, present in an amount of about 2 percent by weight, and a butylated hydroxy tuluene preservative, present in an amount of about 1 percent by weight, is present in the development housing of the imaging apparatus. The image is developed with the liquid developer and transferred to the coated paper substrate of Example II by pressing the substrate into contact with the photoreceptor with a blade to assure firm contact of the paper to the image, activating a transfer corotron and depositing a charge on the back of the substrate to attract the image to the substrate, and removing the substrate from the photoreceptor. The transferred image on the substrate is then dried by exposing it to forced air from a blower inside the imaging apparatus until completely dry. Upon drying of the substrate, the image exhibits a substantially permanent quality and no smearing of the image is observed when the image is rubbed with human fingers or with a tissue.

Other embodiments and modifications of the present invention may occur to those skilled in the art subsequent to a review of the information presented herein; these embodiments and modifications, as well as equivalents thereof, are also included within the scope of this invention.

What is claimed is:

1. A process for forming permanent electrophotographic images comprising: (a) generating, in an electrophotographic imaging apparatus, an electrostatic latent image; (b) developing said image with a liquid developer composition comprising a colorant, a solvent and a polymeric material having adhesive properties when wetted with said solvent and exhibiting solubility in said solvent; (c) transferring said image to a substrate while said image is wet, said substrate having a coating comprising said polymeric material; and (d) permitting said image to dry on said substrate.

2. A process in accordance with claim 1 wherein said coating is present on said substrate in an amount of from about 1 to about 100 grams per square meter.

3. A process in accordance with claim 2 wherein said coating is present on said substrate in an amount of from about 6 to about 8 grams per square meter.

4. A process in accordance with claim 1 wherein said solvent comprises an isoparaffinic hydrocarbon.

5. A process in accordance with claim 1 wherein said polymeric material comprises a vinyl toluene acrylic terpolymer.

6. A process in accordance with claim 5 wherein the solvent of the developer comprises an isoparaffinic hydrocarbon.

7. A process in accordance with claim 6 wherein the coating for the substrate is present in an amount of from about 1 to about 100 grams per square meter.

8. A process in accordance with claim 7 wherein said coating is present in an amount of from about 6 to about 8 grams per square meter.

9. A process in accordance with claim 1 wherein said coating includes a pigment material.

10. A process in accordance with claim 9 wherein said pigment material is a silica.

11. A process in accordance with claim 1 wherein said coating includes a vinyl resin composition.

12. A process in accordance with claim 1 wherein said polymeric material comprises a vinyl toluene acrylic terpolymer and said coating includes a vinyl resin composition.

13. A process in accordance with claim 12 wherein said solvent comprises an isoparaffinic hydrocarbon, and said coating is present in an amount of from about 1 to about 100 grams per square meter.

14. A process in accordance with claim 13 wherein said coating is present in an amount of from about 6 to about 8 grams per square meter.

15. A process in accordance with claim 12 wherein said polymeric material is present in said coating in an amount of from about 30 to 100 percent by weight, and said vinyl resin composition is present in said coating in an amount of from about 1 to about 70 percent by weight.

16. A process in accordance with claim 15 wherein said polymeric material is present in said coating in an amount of from about 80 to about 95 percent by weight, and said vinyl resin composition is present in said coating in an amount of from about 1 to about 20 percent by weight.

17. A process in accordance with claim 12 wherein said coating includes a pigment material.

18. A process in accordance with claim 17 wherein said solvent is an isoparaffinic hydrocarbon, and said coating is present in an amount of from about 1 to about 100 grams per square meter.

19. A process in accordance with claim 18 wherein said coating is present in an amount of from about 6 to about 8 grams per square meter.

20. A process in accordance with claim 17 wherein said polymeric material is present in said coating in an amount of from about 30 to 100 percent by weight, said vinyl resin composition is present in said coating in an amount of from about 1 to about 70 percent by weight, and said pigment material is present in said coating in an amount of from about 1 to about 50 percent by weight.

21. A process in accordance with claim 20 wherein said polymeric material is present in said coating in an amount of from about 80 to about 95 percent by weight, said vinyl resin composition is present in said coating in an amount of from about 1 to about 20 percent by weight, and said pigment material is present in said coating in an amount of from about 1 to about 50 percent by weight.

22. A process in accordance with claim 1 wherein said polymeric material comprises a vinyl toluene acrylic terpolymer and said coating includes a pigment material.

23. A process in accordance with claim 22 wherein said solvent comprises an isoparaffinic hydrocarbon, and said coating is present in an amount of from about 1 to about 100 grams per square meter.

24. A process in accordance with claim 23 wherein said coating is present in an amount of from about 6 to about 8 grams per square meter.

25. A process in accordance with claim 22 wherein said polymeric material is present in said coating in an amount of from about 30 to 100 percent by weight and said pigment material is present in said coating in an amount of from about 1 to about 50 percent by weight.

26. A process in accordance with claim 25 wherein said polymeric material is present in said coating in an amount of from about 80 to about 95 percent by weight, and said pigment material is present in said coating in an amount of from about 1 to about 50 percent by weight.

27. A process in accordance with claim 1 wherein said electrophotographic imaging device is a Xerox® 175 Medical Imaging System.

28. A process in accordance with claim 3 wherein said electrophotographic imaging device is a Xerox® 175 Medical Imaging System.

* * * * *